US009038323B2

(12) United States Patent
Fradera Pellicer

(10) Patent No.: US 9,038,323 B2
(45) Date of Patent: May 26, 2015

(54) INSTALLATION FOR MANUFACTURING A PREFABRICATED REINFORCED CEMENT MORTAR PANEL

(76) Inventor: Carlos Fradera Pellicer, La Massana (AD)

( * ) Notice: Subject to any disclaimer, the term of this patent is extended or adjusted under 35 U.S.C. 154(b) by 450 days.

(21) Appl. No.: 13/521,330

(22) PCT Filed: Jan. 26, 2010

(86) PCT No.: PCT/ES2010/000025

§ 371 (c)(1),
(2), (4) Date: Jul. 10, 2012

(87) PCT Pub. No.: WO2011/104390

PCT Pub. Date: Sep. 1, 2011

(65) Prior Publication Data

US 2012/0285006 A1 Nov. 15, 2012

(51) Int. Cl.
*E04G 11/04* (2006.01)
*B28B 23/00* (2006.01)

(52) U.S. Cl.
CPC ..... *B28B 23/0056* (2013.01); *Y10T 29/53* (2015.01); *B28B 23/0062* (2013.01)

(58) Field of Classification Search
CPC .. B28B 23/0056; B28B 23/0062; Y10T 29/53
USPC ..... 52/125.1, 125.2, 125.3, 125.4, 125.5, 52/125.6, 701, 704, 707, 708; 294/81.53
See application file for complete search history.

(56) References Cited

U.S. PATENT DOCUMENTS 2,772,560 A * 12/1956 Neptune ..... 52/707
4,017,115 A * 4/1977 Holt et al. ..... 294/89
4,079,983 A * 3/1978 Van Mastrigt ..... 294/89
4,290,638 A * 9/1981 Manning ..... 294/89
4,325,575 A * 4/1982 Holt et al. ..... 294/89
4,367,892 A * 1/1983 Holt ..... 294/89
4,437,276 A * 3/1984 Goldberg ..... 52/125.5
4,437,642 A * 3/1984 Holt ..... 249/175

(Continued)

FOREIGN PATENT DOCUMENTS

DE 3714581 A1 11/1988
EP 0493140 A1 7/1992

(Continued)

OTHER PUBLICATIONS

International Searching Authority, International Search Report for International Application No. PCT/ES2010/000025, mailed Oct. 4, 2010, 5 pages, Spain Patent and Trademark Office, Madrid.

*Primary Examiner* — Adriana Figueroa
(74) *Attorney, Agent, or Firm* — Alston & Bird LLP

(57) ABSTRACT

Anchor positioning equipment for pre-fabricating panels of reinforced cement mortar (10) that includes a prestressed biaxial reinforcement (9). The panel has some versatile actuator means (6) embedded into the mass of cement mortar (10), that do not project from any of the faces (11) thereof, for handling and/or securing said panel to the structure of a building. The means (6) comprise, on the one hand, means for retaining (13) in the set mortar mass and, panel anchoring means (14). The equipment has a fixed base structure (2) for supporting stable seat elastic arrangements (5), which receive means (6) and, on the other hand, movable frameworks (1) comprising gripping arrangements (3) for gripping means (6). Movable frameworks (1) are responsible for removing means (6) from stable seat elastic arrangements (5).

10 Claims, 8 Drawing Sheets

(56) References Cited

U.S. PATENT DOCUMENTS

| | | | | | |
|---|---|---|---|---|---|
| 4,483,121 | A * | 11/1984 | Froening et al. | 52/698 |
| 4,512,121 | A * | 4/1985 | Carydias et al. | 52/125.2 |
| 4,676,035 | A * | 6/1987 | GangaRao | 52/125.5 |
| 5,226,265 | A * | 7/1993 | Kelly et al. | 52/125.6 |
| 6,092,849 | A * | 7/2000 | Zambelli et al. | 294/89 |
| 6,568,730 | B1 * | 5/2003 | Paterson | 294/89 |
| 6,694,680 | B2 * | 2/2004 | Zambelli et al. | 52/125.2 |
| 6,792,734 | B2 * | 9/2004 | Zambelli et al. | 52/698 |
| 7,677,829 | B2 * | 3/2010 | Westhoff et al. | 403/2 |
| 2011/0262263 | A1 * | 10/2011 | Comerford et al. | 414/800 |

FOREIGN PATENT DOCUMENTS

| | | | |
|---|---|---|---|
| ES | 1057874 | U | 10/2004 |
| ES | 1065420 | U | 8/2007 |
| WO | WO 2004/020761 | A1 | 3/2004 |

* cited by examiner

INSTALLATION FOR MANUFACTURING A PREFABRICATED REINFORCED CEMENT MORTAR PANEL

CROSS REFERENCE TO RELATED APPLICATIONS

This application is a national stage application, filed under 35 U.S.C. §371, of International Application No. PCT/ES2010/000025, filed Jan. 26, 2010, which is hereby incorporated by reference in its entirety.

BACKGROUND OF THE INVENTION

1. Related Field

This invention relates, as its title indicates, to anchor positioning equipment in prefabricating reinforced mortar panels, particularly equipment that facilitates and secures the positioning of the versatile actuator means that are incorporated into the prefabricated cement mortar panels that are reinforced two-dimensionally to facilitate their maintenance during stripping, transport and on-site implementation operations and for anchoring to the structure of a building.

2. Related Art

The registration of Utility Model No. 200401484 is known, the owner of which is the applicant of this invention, which registration discloses a wide and extensive head piece with multiple grip. This head piece can grip, in a simultaneous, coplanar manner, a plurality of elements that are positioned in orderly fashion in a work post, move them in orderly fashion to another work post and place them in the same post in an identical position with respect to that arranged initially.

The gripping head piece is applied particularly in manufacturing panels for construction based on prestressed, two-dimensionally reinforced cement mortar. On these panels, on their non-visible face, metallic elements are located, in the form of omega shaped sections that sink into the mortar mass before it sets. The metallic elements are for installing the panels in the building structure. Also, they form gripping means for handling the panels during stripping, storage, transport and positioning.

To date, inserting these metallic elements into the back of the panel while moulding it, was done by hand and had to be done very accurately in a minimum length of time, so as to do it before the mortar started to set. The consequence of this was the slowness in manufacturing the panels and the increase in the product price.

In order to overcome these disadvantages, the solution was adopted to create means, reflected in Utility Model ES 1057 874. These means allow, on the one hand, arranging the metallic elements in orderly fashion so that their arrangement adjusts to the arrangement of the panel reinforcements and does not interfere with them and, on the other hand, that said elements can be sunk simultaneously into the back of the recently moulded panel before it starts to set.

Despite the good result of the invention, practice has shown that using said metallic elements in the form of omega shaped sections meant that the panels had on their non-visible face the projections of said omega shaped sections intended for handling and attaching them to the building structure. This, in spite of facilitating panel handling, makes it necessary to provide protection means when storing and transporting panels, so as to avoid any friction that could deteriorate the correct appearance of the texture or shine of the visible faces.

In order to overcome the mentioned drawbacks, the solution was adopted to replace said metallic elements in the form of omega sections with means for securing the panel to the structure, which are fully inserted inside the panel, while, nevertheless, being accessible from the non-visible face of the panels, but without projecting from said face.

According to the above solution, as contemplated in Utility Model No. 200700993, said means for securing the panel to the structure of the building, defined with a greater range of functions as versatile actuator means, are hidden in the mortar mass, interspersed in the space of some of the grid squares and even straddling the prestressed cables of the two-dimensional reinforcement of said panels.

These versatile actuator means have, on the one hand, means for being retained in the set mortar mass and, and on the other hand, opposed to the former, anchor means for elements for handling and/or securing to the building structure.

Said versatile actuator means are made up of blocks which are inserted in the mortar mass before it sets, and inside the mortar mass without reaching the visible face of the panel, whereas the means for anchoring to the building structure have an area thereof level with the surface of the non-visible face of the panel.

At any event there is the drawback that the metallic elements intended for handling and securing the panels to the structure of a building, must be inserted into the mortar mass before this starts to set. This was resolved for the omega sections by means of the devices in Utility Model No. 200401484.

When carrying out the positioning of the said versatile actuator means foreseen in Utility Model No. 200700993, since the mentioned devices are not appropriate, the solution has been adopted to position the means in orderly fashion on a template. After positioning the versatile actuator means they are gripped simultaneously and inserted through the non-visible face of the panel recently formed in the mould, and remaining in said position until the mortar acquires sets sufficiently for the panel to be stripped.

BRIEF SUMMARY

In order to carry out the task explained above the anchor positioning equipment in pre-fabricating reinforced mortar panels has been developed, which is the aim of the invention, comprising, on the one hand, a fixed base structure intended to support horizontally a plurality of stable seat elastic arrangements that are suitable for positioning therein an equal plurality of versatile actuator means and, on the other hand, movable frameworks that include, in orderly fashion to coincide with the stable seat elastic arrangements located on the fixed base structure for positioning said versatile actuator means, gripping arrangements for gripping the versatile actuator means that grip them as in each case one of said movable frameworks is tightly positioned against the fixed base structure and, due to their movable condition, remove from the stable seat elastic arrangements on the fixed base structure the versatile actuator means that are positioned on said elastic arrangements.

One feature of the invention consists of the fact that the stable seat elastic arrangements are made up of a fixed base body and a movable seat body for the versatile actuator means with a lower part that slides on the inside of the former and another upper part that is exterior to the said fixed body and forms a seating tray for an elastic plate that forms a flat hollow for fitting the retention means for retaining the versatile actuator means in the set mass of cement mortar.

Another characteristic related to the above lies in the fact that the fixed base body includes fixed in the inside thereof a guide bushing for sliding the movable body and a radial finger in cantilever arrangement the point of which, moving along the inside of a short groove on said movable body, determines the limits of movement of the latter when loaded by a spring located between said fixed body base and the tray of the movable body and/or by stress applied on said tray.

Also, a characteristic of the invention is the fact that the movable framework has as many fixed guides, distributed along the ledger and tie beams covered by the actual movable framework and integral with it, as there are seating devices on the fixed structure, housing in a sliding manner, although occasionally fixed, a gripping rod having gripping means for gripping at one end of the versatile actuator means, while near the other end, ending in a frustoconical shape, it has a wide semitoric groove.

Other characteristics associated to the above lie in the fact that the gripping rod is included by its gripping end to one end of the versatile actuator means located on the stable seat elastic arrangements of the fixed base structure and that the gripping rods when they act on the versatile actuator means are loaded by releasable means that immobilize them with respect to the corresponding guide and retention support, at least when interacting with said versatile actuator means.

The invention contemplates the characteristic whereby some of the releasable gripping arrangements act as traction means for the traction of the movable framework with respect to the reinforced mortar panel once it is at the stripping stage.

Also, the invention has a characteristic related to the one above whereby the gripping arrangements acting as traction means for stripping the panel are associated with a fork restraint that can be inserted into the wide groove of the gripping rod of the gripping arrangement.

Finally, the invention contemplates the fact that the movable framework holds a metallic reinforcement which, arranged to be applied against the surface of the layer of cement mortar, is connected to a terminal of high frequency electricity endothermic effect generator, while another terminal of the same generator is connected to the mould which shapes the thick layer of mortar cement so as to accelerate the setting of said mortar, without thereby excluding that the heavy metallic reinforcement of the movable framework, although acting as an upper reinforcement in a high frequency endothermic system, at all events acts to shape the surface of the layer of cement mortar that will form the non-visible face of the panel and will close the mould to prevent water from evaporating from the mortar as it sets.

BRIEF DESCRIPTION OF THE FIGURES

To facilitate the understanding of the ideas expounded, while at the same time disclosing several constructive details, an embodiment of this invention is described below, with reference to the drawings accompanying this specification, and in view of their essentially illustrative purpose, they should be interpreted as being non-limiting with respect to the scope of the legal protection that is sought, and in these drawings.

DETAILED DESCRIPTION OF VARIOUS EMBODIMENTS

Figure 1:
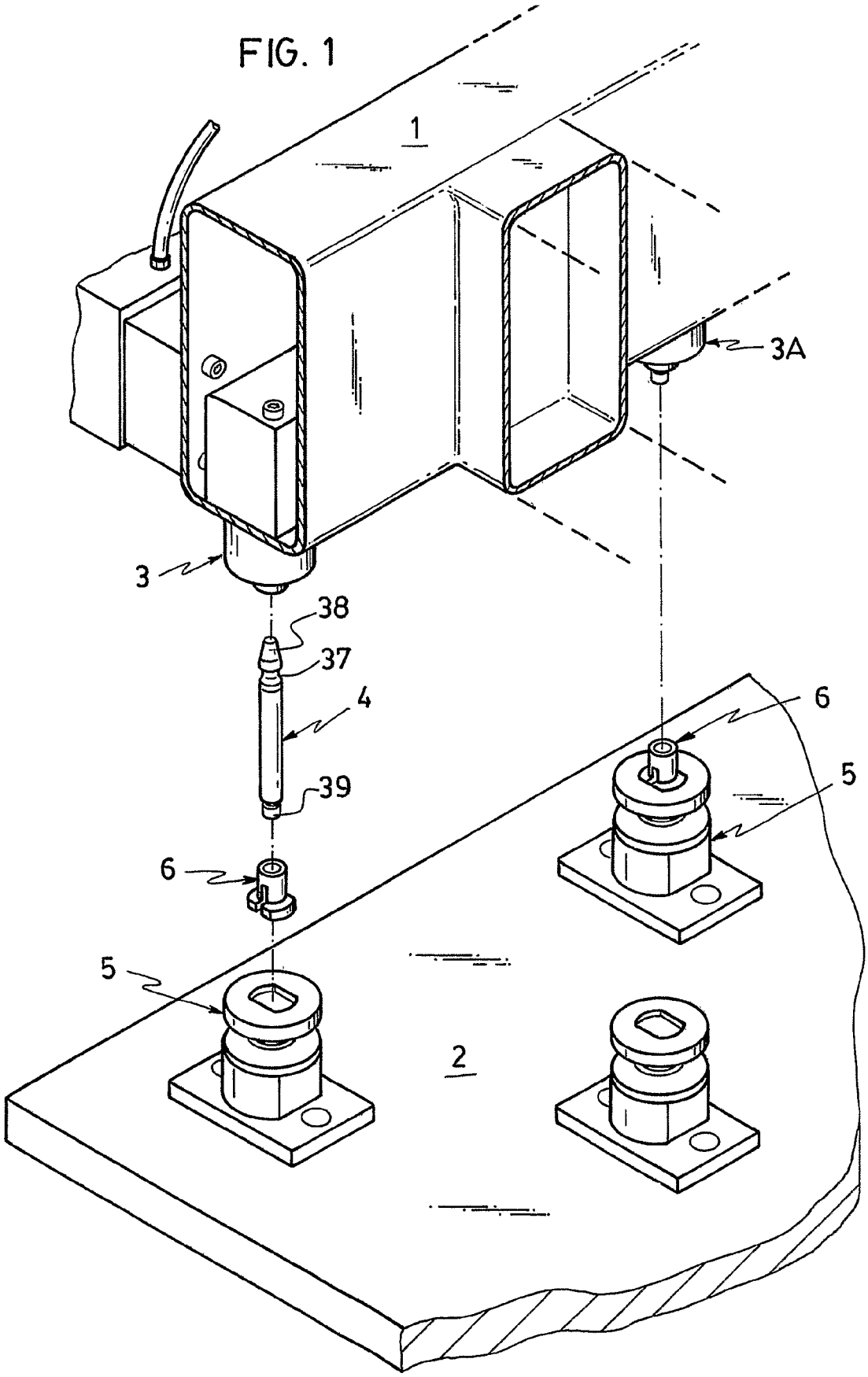
FIG. 1, is a perspective view of a part of the equipment of the invention, in a position prior to the gripping in orderly fashion of the blocks making up the versatile actuator means located on the stable seat elastic arrangements therefor, which comprises in an exploded view the fixed base structure with stable seat elastic arrangements including the corresponding blocks, the gripping rods and the movable framework with its gripping arrangements in which said gripping rods will be housed.

FIG. 1 shows an embodiment of the equipment according to the invention, which comprises a movable framework 1 and a fixed base structure 2. On the movable framework there are gripping arrangements 3 of gripping rods 4 and on the later there are stable seat elastic arrangements 5 for versatile actuator means 6, which in this case are in the form of blocks. All of them are in a position prior to the gripping in orderly fashion of blocks 6 located in stable seat elastic arrangements 5 in vertical correspondence with gripping arrangements 3. In one of the gripping arrangements 3 a block 6 is inserted.

Figure 2:
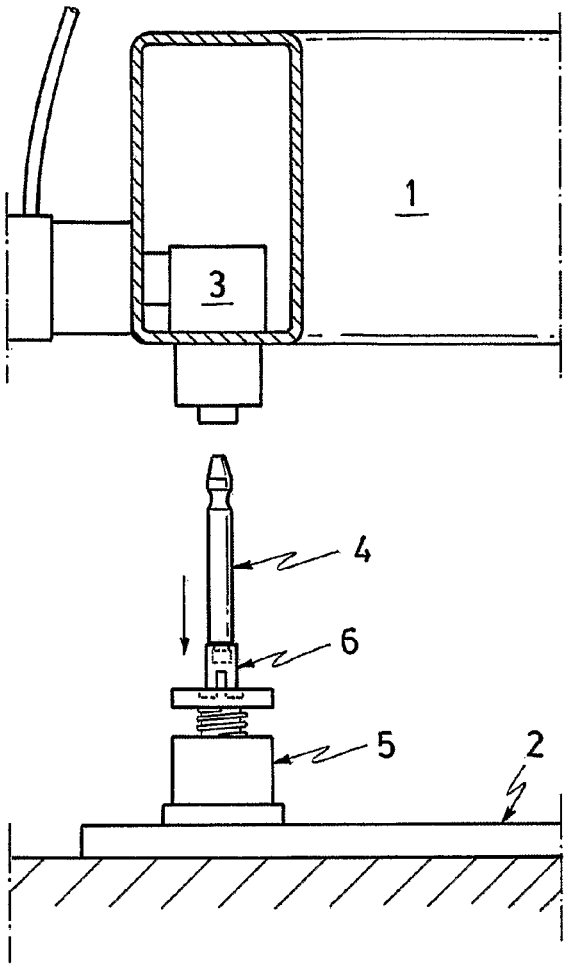
FIG. 2, is an elevation view, partially sectioned, of the part of the equipment in the preceding figure once the blocks forming the versatile actuator means have been put in position in the seat elastic arrangements and the gripping rods in said blocks, this unit being arranged vertically with respect to the gripping arrangements located on the movable framework, which are still separated from the gripping rods awaiting descent.

FIG. 2 shows the equipment of the preceding figure once blocks 6 have been placed in stable seat elastic arrangements 5 and gripping rods 4 in said blocks 6. The unit is arranged on the vertical of gripping arrangements 3 located on movable framework 1, with gripping arrangements 3 being separated from gripping rods 4 waiting for the descent of said movable framework 1.

Figure 3:
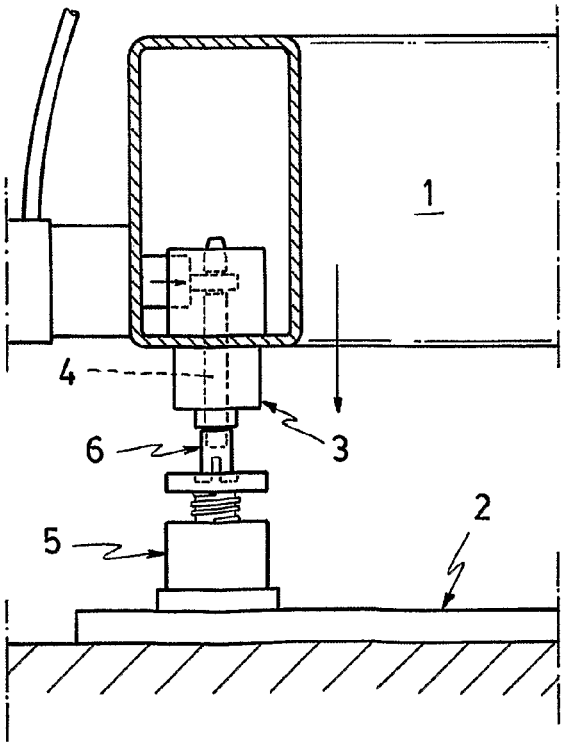
FIG. 3, shows, similar to the preceding figure, when the movable framework has descended retaining with the gripping arrangements the gripping rods which, in turn, are fitted in the blocks forming the versatile actuator means.

FIG. 3 shows when movable framework 1 has descended to fit gripping rods 4 into gripping arrangements 3. In turn, gripping rods 4 are fitted into blocks 6 that form the versatile actuator means.

Figure 4:
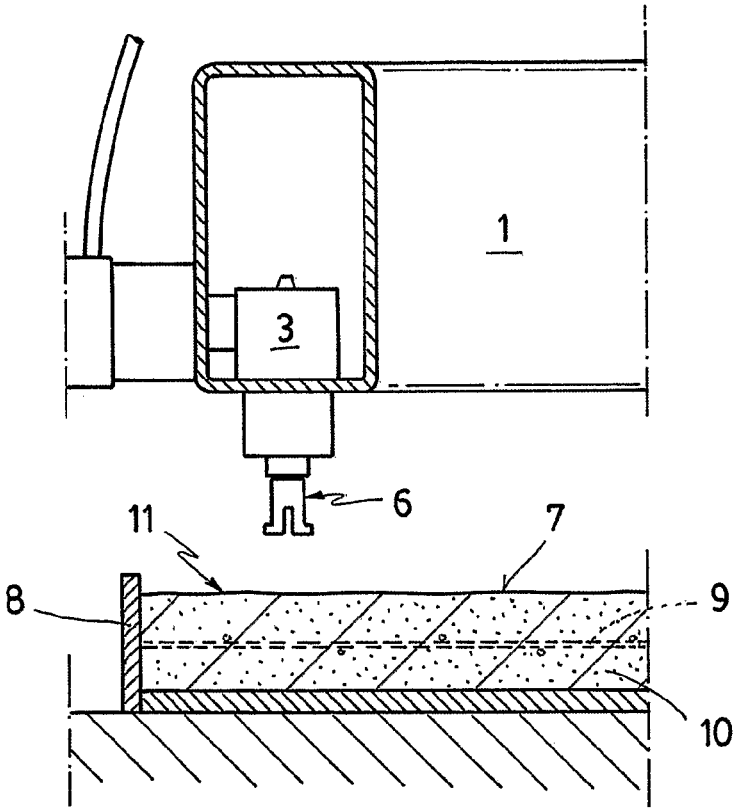
FIG. 4, shows the unit in the preceding figure wherein the movable framework faces the blocks, now withdrawn from the elastic seat arrangements, to the free surface of a mould that includes a two-dimensionally prestressed reinforcement and a thick layer of concrete mortar recently poured into it.

FIG. 4 shows the unit of the preceding figure when movable framework 1 faces blocks 6, now removed from stable seat elastic arrangements 5 and retained in gripping rods 4, to free surface 7 of a mould 8. Mould 8 includes a two-dimensionally prestressed reinforcement 9 and a recently poured thick layer of cement mortar 10 that forms the non-visible face of a panel 11.

Figure 5:
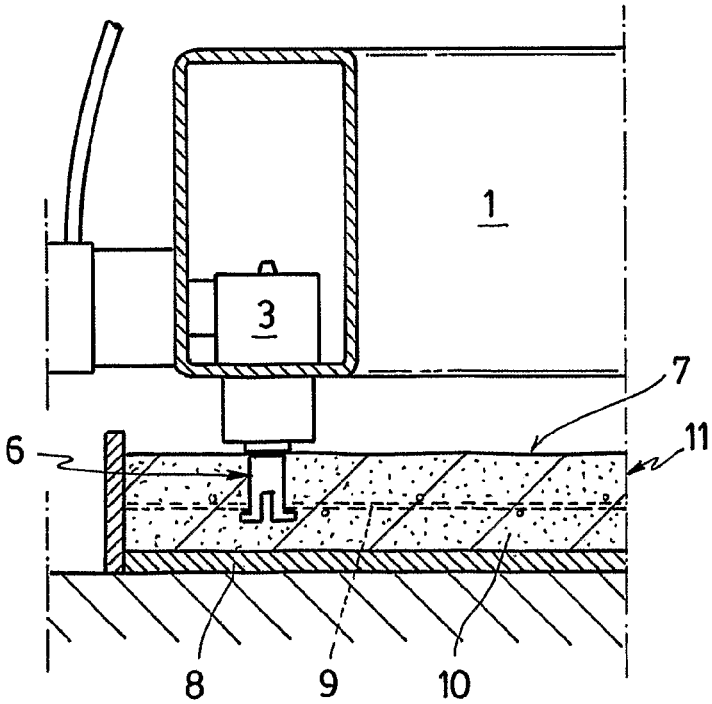
FIG. 5, shows the unit in the preceding figure wherein the movable framework, once the blocks have been inserted into the layer of cement mortar, remains immobile until a degree of setting is reached whereby the formed panel can be stripped from the mould.

FIG. 5 shows the unit of the preceding figure, when blocks 6 have been inserted into layer of cement mortar 10, it remains immobile until said layer of cement mortar 10 reaches a sufficient degree of setting whereby the formed panel (11) can be stripped from the mould.

Figure 6:
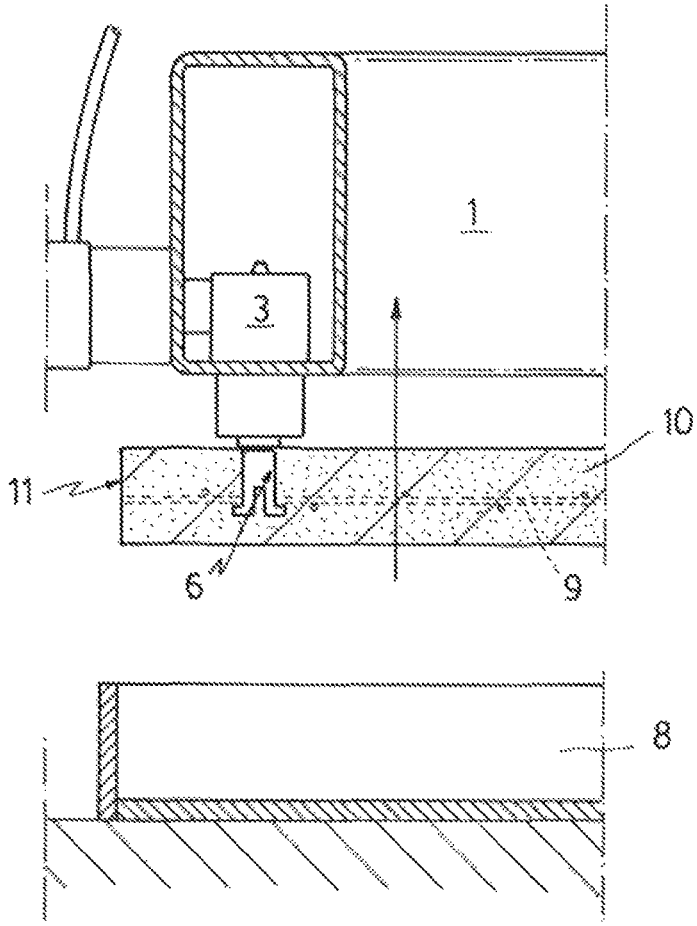
FIG. 6, shows the unit in the preceding figure when the movable framework strips the obtained panel from the mould once the cement mortar placed in the mould to form the thick layer has set.

FIG. 6 shows the unit in the preceding figure when movable framework 1 strips panel 11 obtained after setting the thick layer of cement mortar 10 laid in mould 8.

Figure 7:
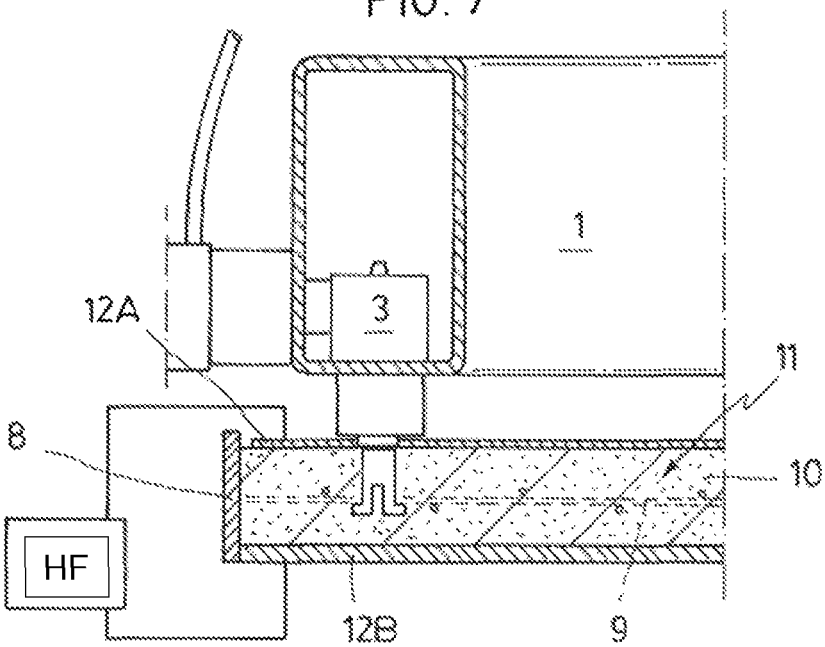
FIG. 7, shows diagrammatically, when the equipment comprises an accelerated setting arrangement by means of high frequency electric current.

The case of FIG. 7 corresponds, diagrammatically, to the case wherein the equipment comprises an accelerated setting arrangement using high frequency electric current. The arrangement is made up of an upper metallic reinforcement 12A preferably incorporated into movable framework 1, a lower metallic reinforcement 12B and a high frequency electric current generator HF.

Also, heavy upper metallic reinforcement 12A incorporated into movable framework 1, although acting as an upper reinforcement in a high frequency endothermic system, at all events acts to shape the surface of the layer of cement mortar 10 that will form the non-visible face of panel 11 and the closure of mould 8 to prevent water from evaporating from the mortar as it sets.

Figure 8:
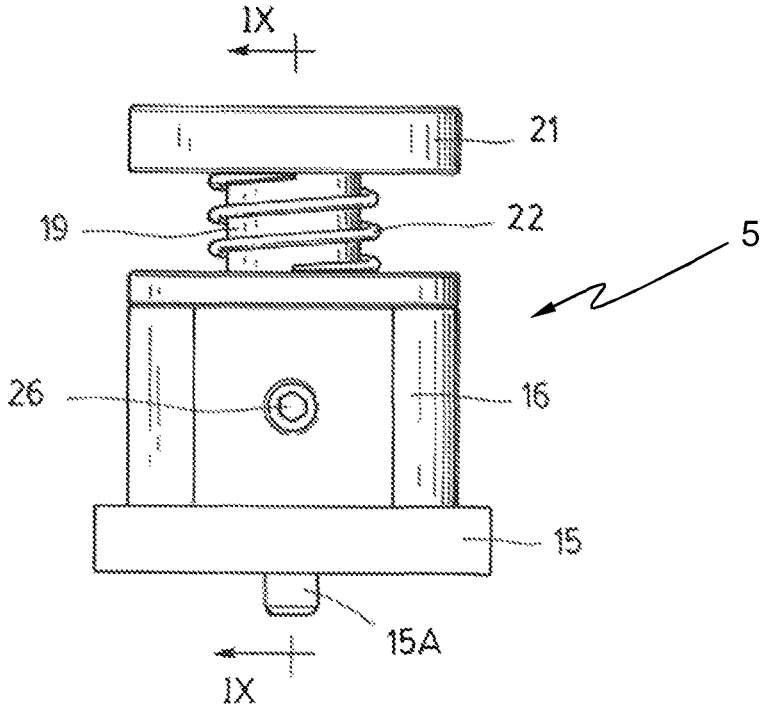
FIG. 8, shows, in an elevation view and in an inactive position, an stable seat elastic arrangement intended to support in a stable manner one of the versatile actuator means, particularly one of the type of blocks that form, on the one hand, means for retaining in the set mortar mass and, on the other hand opposite the former, anchoring means for elements for handling and/or fastening to the structure of the building.
Figure 9:
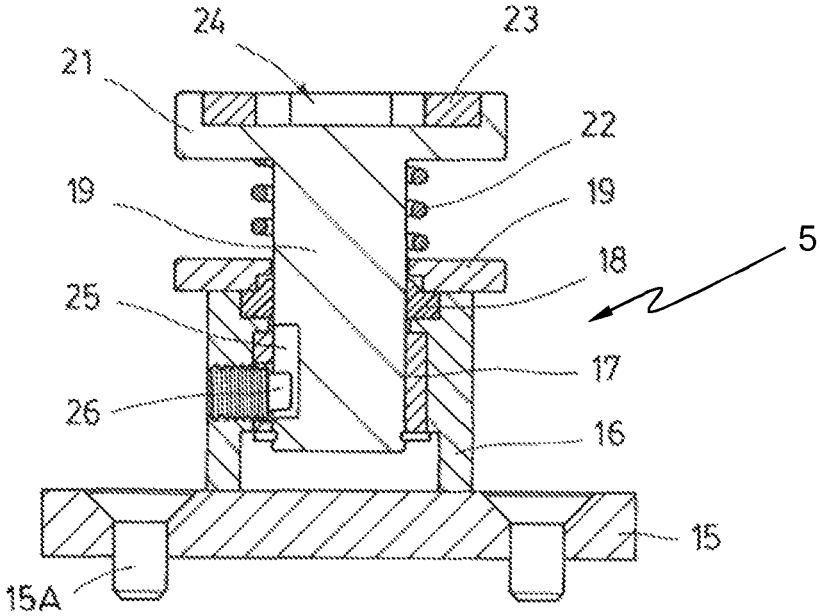
FIG. 9, shows a section along line IX-IX in the preceding figure.

FIGS. 8 and 9 illustrate a preferred embodiment of a stable seat elastic arrangement 5 intended to support in a stable manner one of the versatile actuator means. In this case in particular, it refers to blocks 6 which, as can be seen in detail in FIG. 10, comprise, on the one hand, retention means 13 for retaining in the set mass of cement mortar 10 and, on the other hand opposite the former, anchoring means 14 for handling elements, like gripping rods 4, and/or elements for fastening to the structure of a building, not shown.

Said stable seat elastic arrangement 5 comprises a base 15 provided with anchoring screws 15A for anchoring to fixed base structure 2, a guide body 16, provided with a central self-lubricating bushing 17 and a seal 18 which, closed by an annular lid 19 form a sliding arrangement of foot 20 of a platform 21 loaded by a spring 22 in which there sits a seating plate 23 that has a recess 24 wherein retention means 13 for retaining blocks 6 fit in a stable manner. Foot 20 has axial recess 25 where an end stop 26 is applied fixed to guide body 16, being the function thereof to limit the emerging and descent of platform 21.

Figures 10, 11:
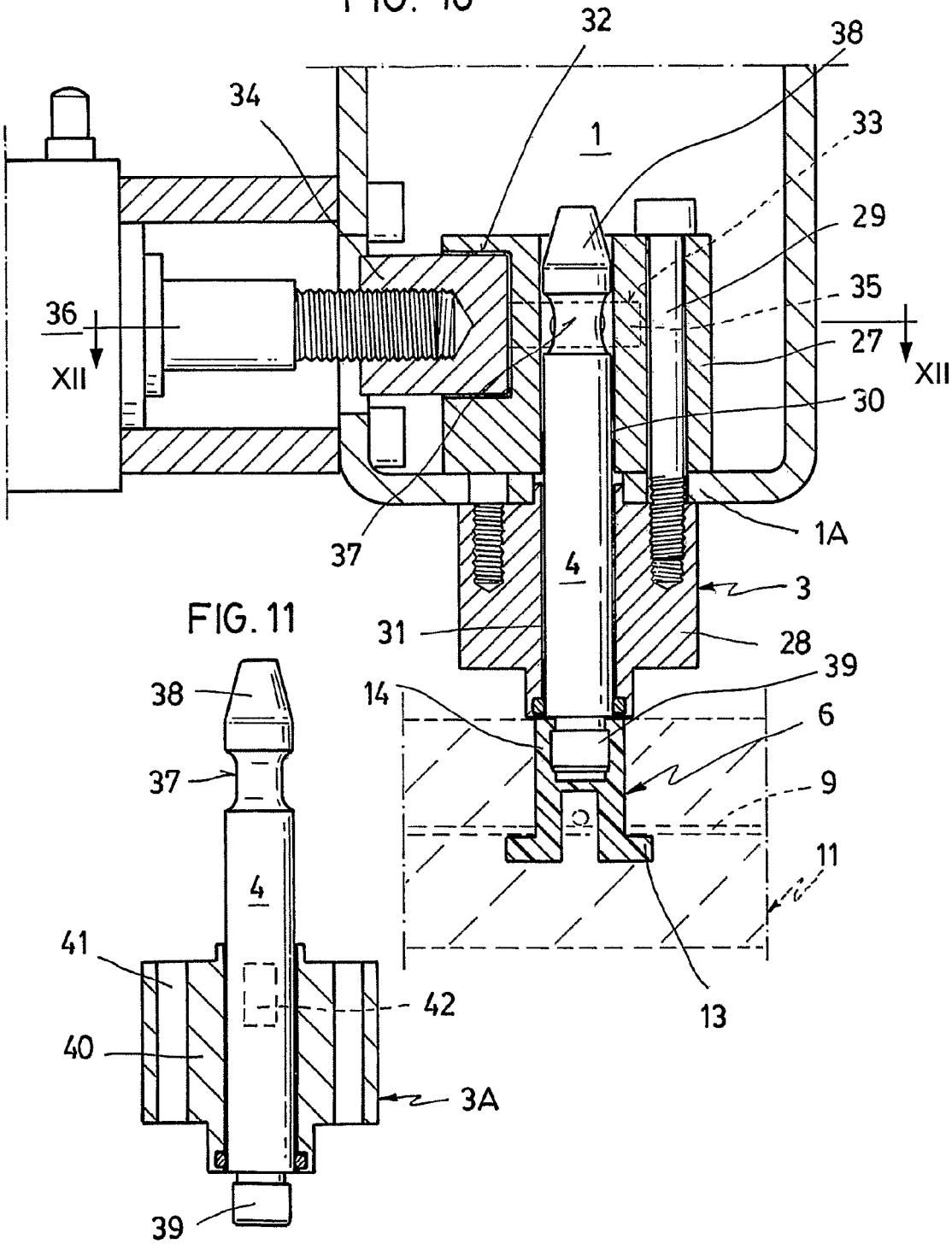
FIG. 10, shows an elevation section of one gripping arrangement of those which, assembled on the movable framework, are likely to exercise a vertical traction force on the set panel so as to strip it out of the mould.
FIG. 11, shows, in section, a gripping arrangement of those where most of them are not associated with means that can exercise said vertical traction force.
Figure 12:
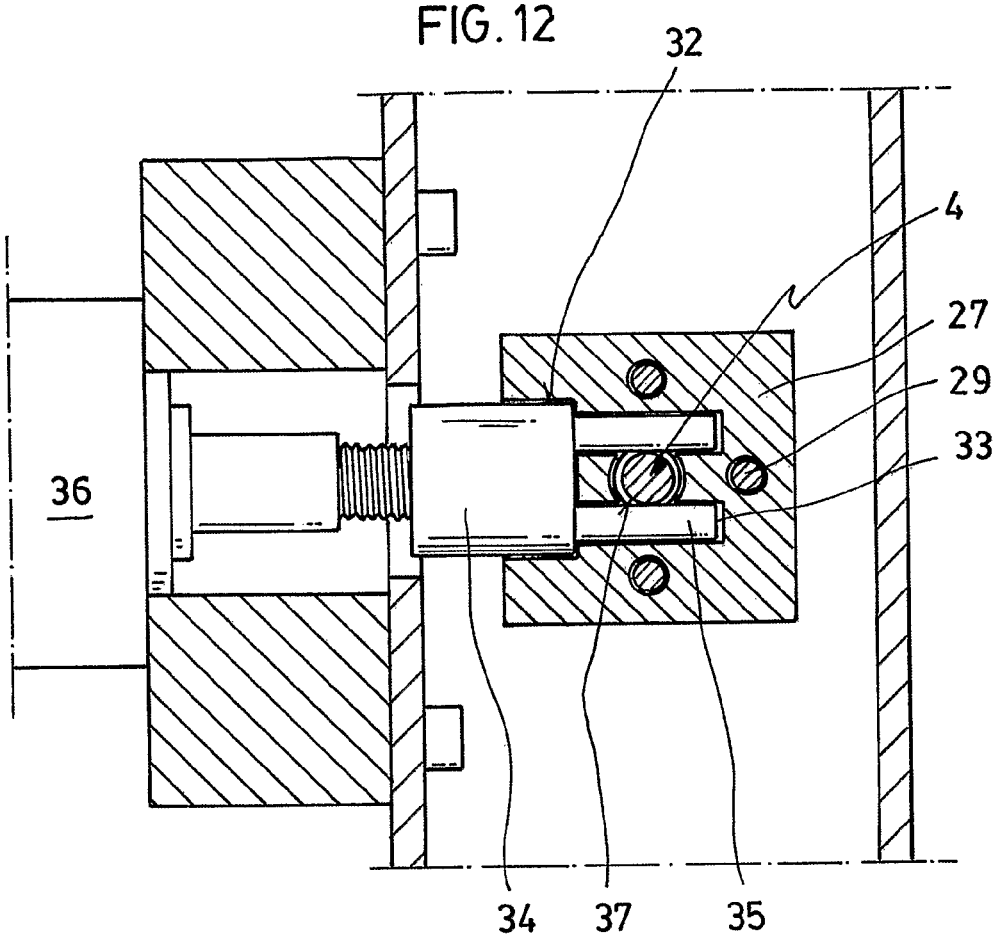
FIG. 12, shows a section along line XII-XII in FIG. 10.

FIGS. 10 and 12 show a gripping arrangement 3 of the ones which, assembled on movable framework 1, are likely to exercise a vertical traction force on panel 11 now set sufficiently to be stripped from the mould.

In said figures it is observed that gripping arrangement 3 installed on movable framework 1 comprises a top guide body 27 and a bottom guide body 28 which, associated to each other imprisoning a wall 1A of movable framework 1 by means of screws 29, forming two vertical concentric housings 30 and 31 for containing a gripping rod 4, which in the drawings grips block 6.

Top guide body 27 has on its side a cylindrical cavity 32 wherein two blind ducts 33 open, coplanar in the transverse direction to the axis of vertical housing 30, with said cylindrical cavity 32 being occupied by a sliding cylindrical body 34 and blind ducts 33 being occupied by respective rods 35 jointly emerging in cantilever arrangement of said sliding cylindrical body 34 and separated from each other at a magnitude smaller than the diameter of vertical housing 30.

The unit made up of said cylindrical sliding body 34 and rods 35 is associated with a motor mechanism 36 that moves it in the axial direction in a space sufficient to separate rods 35 from the surrounds of vertical housing 30.

The plane on which rods 35 are placed coincides with a groove 37 provided at the top end of gripping rods 4, which makes it possible to retain said gripping rods 4 in gripping arrangement 3 when said rods 35 are in the position in which they are housed in blind ducts 33, whereas, on the contrary, said gripping rods 4 are released when rods 35 are moved, withdrawing partially from inside said blind ducts 33.

Motor mechanism 36 can be any of the known types, i.e. hydraulic, pneumatic or electric.

FIGS. 1, 10 and 11 show that gripping rods 4 have a free end 38 ending in a frustoconical shape that begins shortly after groove 37, whereas at the other end they have coupling means 39 for coupling to blocks 6, which can be of the screw, bayonet, magnetic or snap type.

Said FIG. 11 shows a gripping arrangement 3A that consists of a simple bottom guide body 40, equivalent to bottom guide body 28 of gripping arrangement 3, which is provided with holes 41 for the passage of fixing screws for fixing to movable framework 1 and positional retention means 42 for retaining gripping rod 4, not shown, which can be of the friction, magnetic or spring type, that ensure the positioning of gripping rod 4 both in gripping arrangements 3 and in gripping arrangements 3A. On movable framework 1 a limited number of gripping arrangements 3 are provided, which is sufficient for dragging panel 11 when stripping it from the mould, while a necessary number of gripping arrangements 3A will be provided for gripping the blocks 6 not intended for gripping arrangements 3 that are meant to enable mould stripping.

Figure 13:
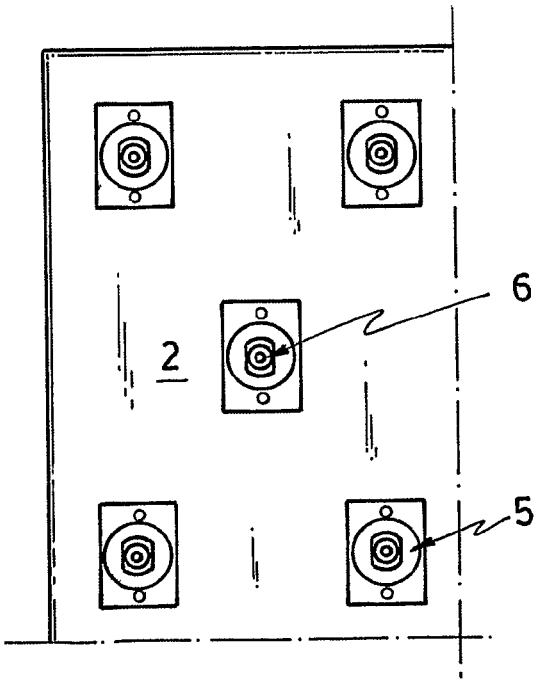
FIG. 13, shows, in a top plan view, a corner of a fixed structure intended to contain in orderly fashion in the stable seat elastic arrangements the corresponding blocks waiting to be retained by the gripping rods and subsequently grasped by the gripping arrangements in the movable framework.

FIG. 13 shows a corner of a fixed structure 2 intended to contain in orderly fashion in stable seat elastic arrangements 5 corresponding blocks 6 waiting to be retained by gripping rods 4 and subsequently gripped by gripping arrangements 3 of movable framework 1.

Figure 14:
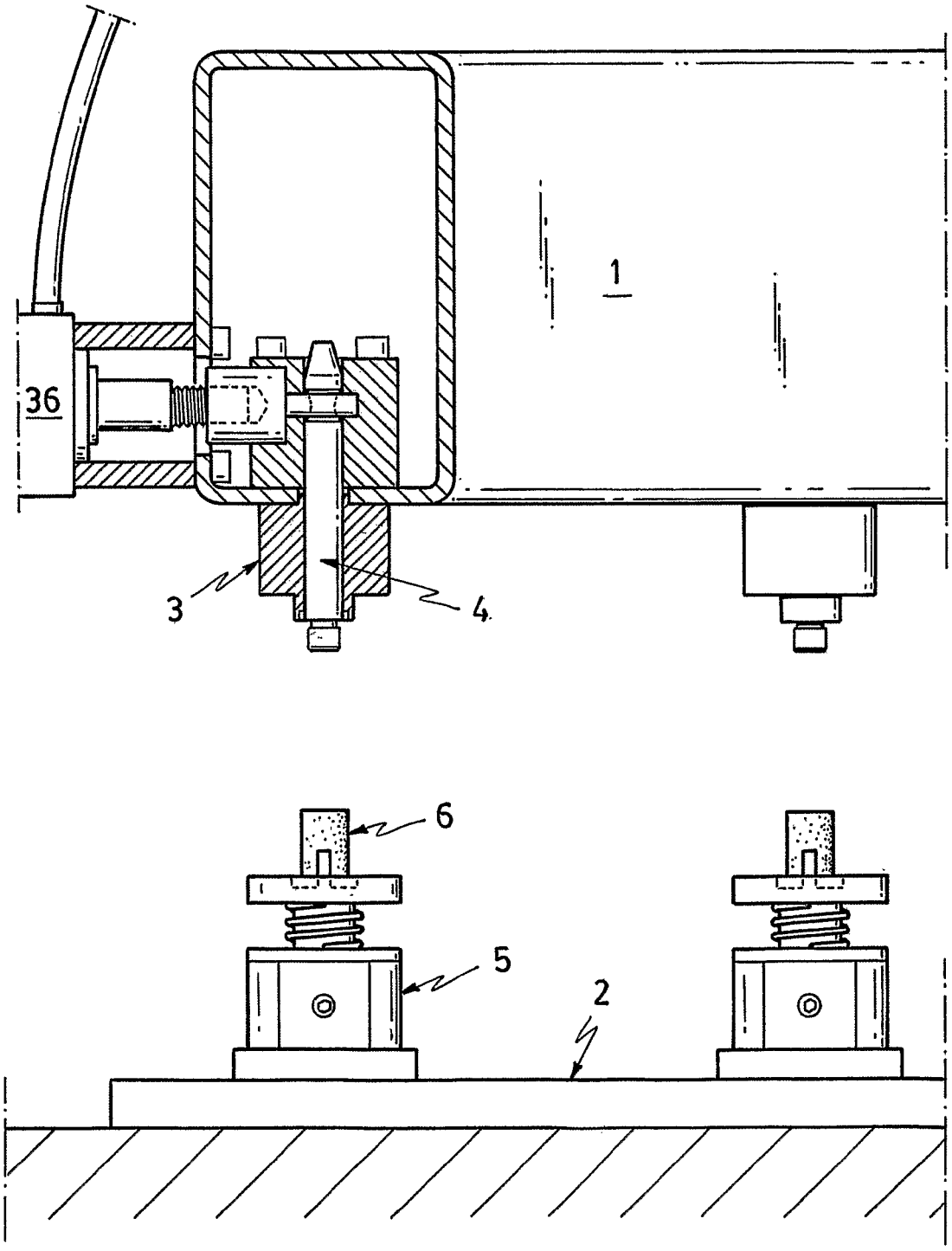
FIG. 14, shows, similar to the preceding figure, the position of the movable framework when the gripping rods have been coupled in the gripping arrangements before catching the blocks.

FIG. 14 shows, similar to FIG. 2 and with the detail of FIG. 10, the position of movable framework 1 in the case where gripping rods 4 have been coupled in gripping arrangements 3 prior to catching blocks 6.

The invention claimed is:

1. Installation for manufacturing a prefabricated cement mortar panel (11)), with a prestressed biaxial reinforcement (9), said panel (11) having versatile actuator means (6) suitable for handling and securing said panel to the structure of a building, said versatile actuator means (6) being embedded into the mass of cement mortar (10) of said panel (11), without projecting from any of the faces thereof, and said versatile actuator means (6) comprising, on one end, retention means (13) for embedding said versatile actuator means (6) in the set mass of cement mortar (10) of said panel (11) and, on the other end opposite the former, anchoring means (14) both for elements for handling said panel and for elements for securing said panel to the structure of a building, said installation comprising an arrangement for handling said versatile actuator means (6) during the process of manufacturing said panel (11); wherein said arrangement comprises:

a fixed base structure (2) for holding said versatile actuator means (6) before the process of embedding said versatile actuator means (6) into the mass of cement mortar (10) of said panel (11); said fixed base structure (2) comprising a plurality of stable seat elastic arrangements (5) distributed over said fixed base structure (2), each of said seat elastic arrangements (5) being configured for receiving one of said versatile actuator means (6); and a movable framework (1) comprising gripping arrangements (3), said gripping arrangements (3) being distributed over said framework (1) so that said gripping arrangements (3) and said stable seat elastic arrangements (5) are aligned with each other, and at least one of said gripping arrangements (3) being configured for simultaneously gripping said versatile actuator means (6) and, due to the movement of said framework (1), drawing said versatile actuator means (6) from said stable seat elastic arrangements (5) of said fixed base structure (2).

2. Installation according to claim 1, wherein said stable seat elastic arrangements (5) are made up of a fixed base body (15, 16) and a movable seat body (20, 21) for receiving said versatile actuator means (6), said movable seat body (20, 21) having a lower part that slides inside said fixed base body (15, 16) and another upper part that projects outside said fixed base body (15, 16) and forms a seating tray for an elastic seating plate (23) that has a hollow (24) for fitting said retention means (13) of said versatile actuator means (6).

3. Installation according to claim 2, wherein said fixed base body (15, 16) comprises firmly in the inside thereof a guide bushing (17) for the sliding of said movable seat body (20, 21) and a radial finger (26) in cantilever arrangement the point of which, moving through the inside of a short groove (25) in said movable seat body (20, 21), determines the limits of movement of said movable seat body (20, 21) when loaded by a spring (22) located between said fixed base body (15, 16) and a platform (21) of said movable seat body (20, 21) or by a stress applied to said platform (21).

4. Installation according to claim 1, wherein said movable framework (1) has as many gripping arrangements (3), as said stable seat elastic arrangements (5) has said fixed base structure (2), being housed in said gripping arrangements (3) in a sliding manner, although temporarily fixed, a gripping rod (4) which at one end includes coupling means (39) for coupling to an end of said versatile actuator means (6), while near the other end, it has a wide semitoric groove (37).

5. Installation according to claim 4, wherein each of said gripping rods (4) is incorporated at one end by said coupling means (39) to an end of said versatile actuator means (6) located in said stable seat elastic arrangements (5) of said fixed base structure (2).

6. Installation according to claim 4, wherein said gripping arrangements (3) are provided with releasable means (34, 35, 36) that operate on said gripping rods (4) to immobilize said gripping rods (4), at least during their interaction with said versatile actuator means (6).

7. Installation according to claim 1, wherein at least one of said gripping arrangements (3) acts as traction means for the traction of said panel (11) by said movable framework (1) when said panel (11) is being stripped from the mould.

8. Installation according to claim 4, wherein said gripping arrangements (3) which act as traction means for stripping said panel (11) from the mould are associated with a fork (34, 35) comprising a pair of rods (35) that can be inserted into said groove (37) of said gripping rod (4).

9. Installation according to claim 1, wherein said movable framework (1) holds a metallic reinforcement (12A, 12B) which is arranged to be applied against a surface of a layer of cement mortar (10) of said panel (11), and wherein said metallic reinforcement (12A, 12B) is connected to a terminal of a high frequency electric current generator (HF), while another terminal of said generator (HF) is connected to a mould (8) that shapes said layer of cement mortar (10), so that a high frequency electric current generated by said generator (HF) accelerates the setting of said layer of cement mortar (10).

10. Installation according to claim 9, wherein said heavy metallic reinforcement (12A, 12B) acts to shape said surface of the layer of cement mortar (10), and wherein said metallic reinforcement (12A, 12B) closes said mould (8) to prevent water from evaporating from the mortar while it sets.

* * * * *